US008382068B2

(12) United States Patent
Christie

(10) Patent No.: US 8,382,068 B2
(45) Date of Patent: Feb. 26, 2013

(54) SCISSOR JACK

(75) Inventor: Colin Christie, Pretoria (ZA)

(73) Assignee: Quaddro Technologies Pty., Ltd., Pretoria (ZA)

( * ) Notice: Subject to any disclaimer, the term of this patent is extended or adjusted under 35 U.S.C. 154(b) by 559 days.

(21) Appl. No.: 12/607,314

(22) Filed: Oct. 28, 2009

(65) Prior Publication Data

US 2010/0065795 A1 Mar. 18, 2010

(30) Foreign Application Priority Data

Oct. 28, 2008 (ZA) ..... 2008/05926

(51) Int. Cl.
*B66F 3/00* (2006.01)

(52) U.S. Cl. ..... 254/126; 254/124; 254/122; 254/128

(58) Field of Classification Search ..... 254/124, 254/126, 122, 128
See application file for complete search history.

(56) References Cited

U.S. PATENT DOCUMENTS

| | | | | |
|---|---|---|---|---|
| 6,161,816 | A | 12/2000 | Kikuchi | |
| 8,052,121 | B2 * | 11/2011 | Christie | 254/122 |
| 2005/0127342 | A1 * | 6/2005 | Voegeli et al. | 254/126 |
| 2009/0200527 | A1 | 8/2009 | Christie | |

FOREIGN PATENT DOCUMENTS

| | | | |
|---|---|---|---|
| GB | 334 283 | A | 9/1930 |

* cited by examiner

*Primary Examiner* — Lee D Wilson
*Assistant Examiner* — Nirvana Deonauth
(74) *Attorney, Agent, or Firm* — Charter IP LLC; Matthew J. Lattig

(57) ABSTRACT

A scissor jack for handling heavy duty work includes four arms hingedly arranged to provide two opposite elbows between a base and a load support, a pair of trunnions, one at each elbow connected by a threaded shaft. One end of the threaded shaft is rotatably engaged in a threaded bush anchored to one elbow on a trunnion to extend beyond the outer corner of the elbow. The jack further includes a movable brace comprising a block slidable on the threaded shaft and carried between a pair of plates which are pivotally secured to the connectors and bent to provide stops for simultaneous location of the arms with spacers on the trunnions to determine the extended position of the jack.

11 Claims, 4 Drawing Sheets

SCISSOR JACK

CROSS-REFERENCE TO RELATED APPLICATION

The present application is related to international patent application number PCT/IB06/54465 by the inventor, filed Nov. 27, 2006 and entitled "SCISSOR JACK", the entire contents of which are hereby incorporated by reference herein.

BACKGROUND

1. Field

The example embodiments in general relate to a scissor jack of the kind referred to in International patent application number PCT/IB2006/054465.

2. Related Art

The specification of the PCT application referred to above and included in this specification in its entirety by reference serves as the related art herein.

SUMMARY

An example embodiment of the present invention is directed to a scissor jack. The scissor jack includes four arms hingedly arranged to provide two opposite elbows between a base and a load support. The scissor jack includes a pair of trunnions, one at each elbow connected by a threaded shaft, with one end of the threaded shaft rotatably engaged in a threaded bush anchored to one elbow on a trunnion to extend beyond the outer corner of the elbow.

In an example, a bush can be secured against the trunnion, and the trunnion and bush can have co-operating abutting formations for overlapping engagement to prevent rotation of the bush against the trunnion. In an example, a harness may extend from the bush to engage the trunnion.

The jack may include a movable brace slidably engaging the shaft between the arms. The jack further includes connectors pivotably supported between the brace and each arm.

Another example embodiment is directed to a scissor jack including four arms hingedly arranged to provide two opposite elbows between a base and a load support, a pair of trunnions, one at each elbow connected by a threaded shaft, and a movable brace slidably engaging the shaft between the arms. The jack includes connectors pivotably supported between the brace and each arm. In an example, the ends of each arm remote from the elbow carries a gear section on the end of an arm support secured to the arm at least from the connector pivot support to its free end.

In an example, each arm may be of channel section along at least part of its length. Further, the arm supports may be secured to the flanges of the channel section; and the gear sections remote from the elbows may be mounted in meshing engagement to either a stand for a base or a load support.

In an example, one end of the threaded shaft may be rotatably engaged in a threaded bush anchored on a trunnion at one elbow to extend substantially beyond the outer corner of that elbow with the trunnion forming the pivot for the arms of the elbow and rotatably mounted in the free ends of the flanges of a channel sectioned arms.

The opposite end of the shaft may be rotatably supported in the trunnion of the other elbow. Further, this opposite end may be secured to the output member of a planetary gearbox.

In a further example, a bracket extending from the planetary gearbox over the trunnion to secure the output member in overlapping engagement with the end of the shaft. Additionally, the input member of the planetary gearbox is connected to a universal joint for transmitting rotational movement to the input member.

In a further example, each of the casing, ring gear, planetary and sun gears, and planetary gear carriers may be provided by metal pressings.

The movable brace may include a block slidable on the threaded shaft and carried between a pair of plates which are pivotally secured to the connectors. Ends of the plates are bent to provide stops for simultaneous location of the arms with spacers on the trunnions to determine the extended position of the jack.

BRIEF DESCRIPTION OF THE DRAWINGS

The example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION

As it is apparent that the specification of PCT/IB2006/054465 describes a scissor jack specifically designed for heavy duty work, the example embodiments as to be shown below provide a scissor jack which is designed to work under conditions even more arduous than those for which the earlier jack was suited.

Figure 1:
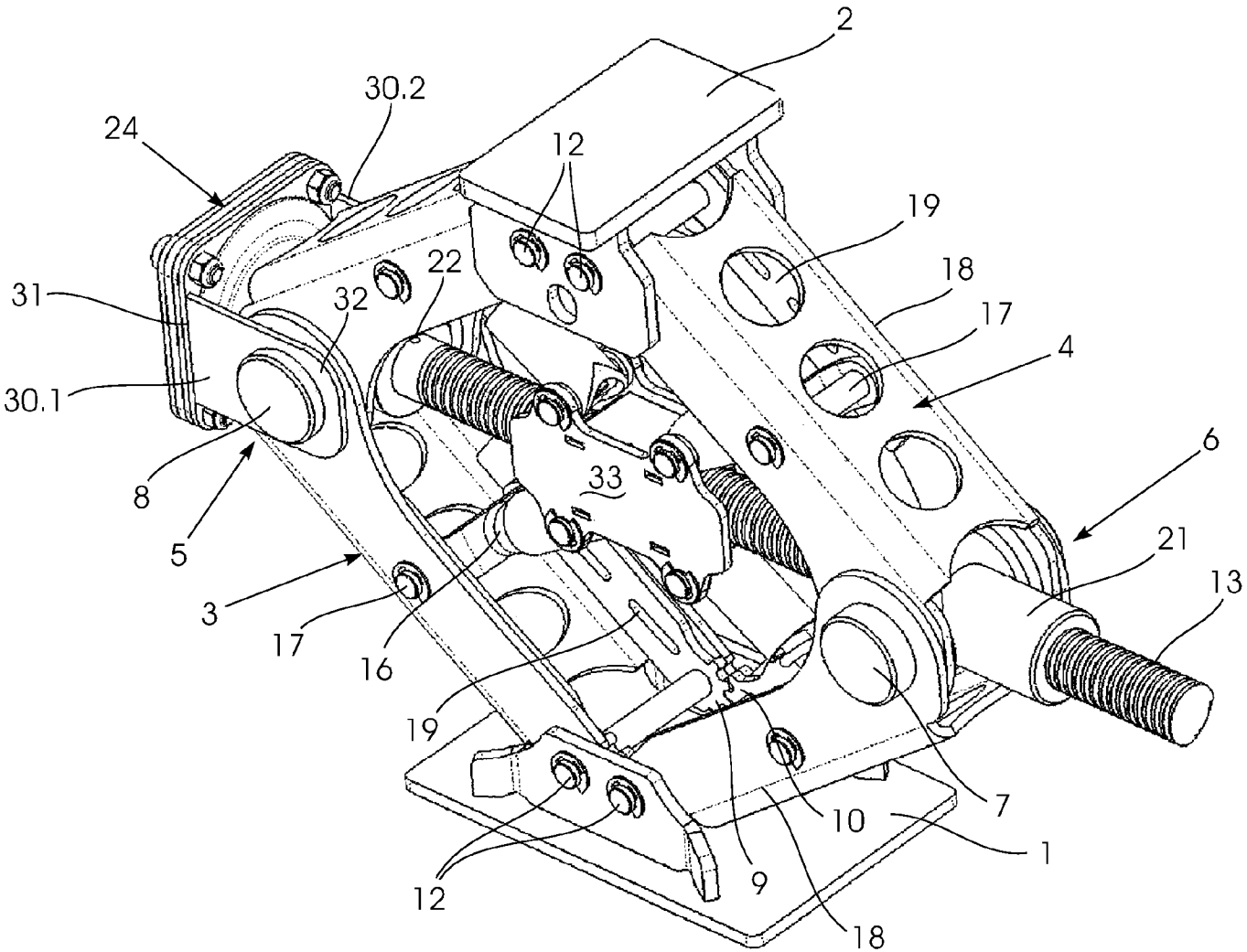
FIG. 1 shows a cross section through the jack in a partially extended position.
Figure 2:
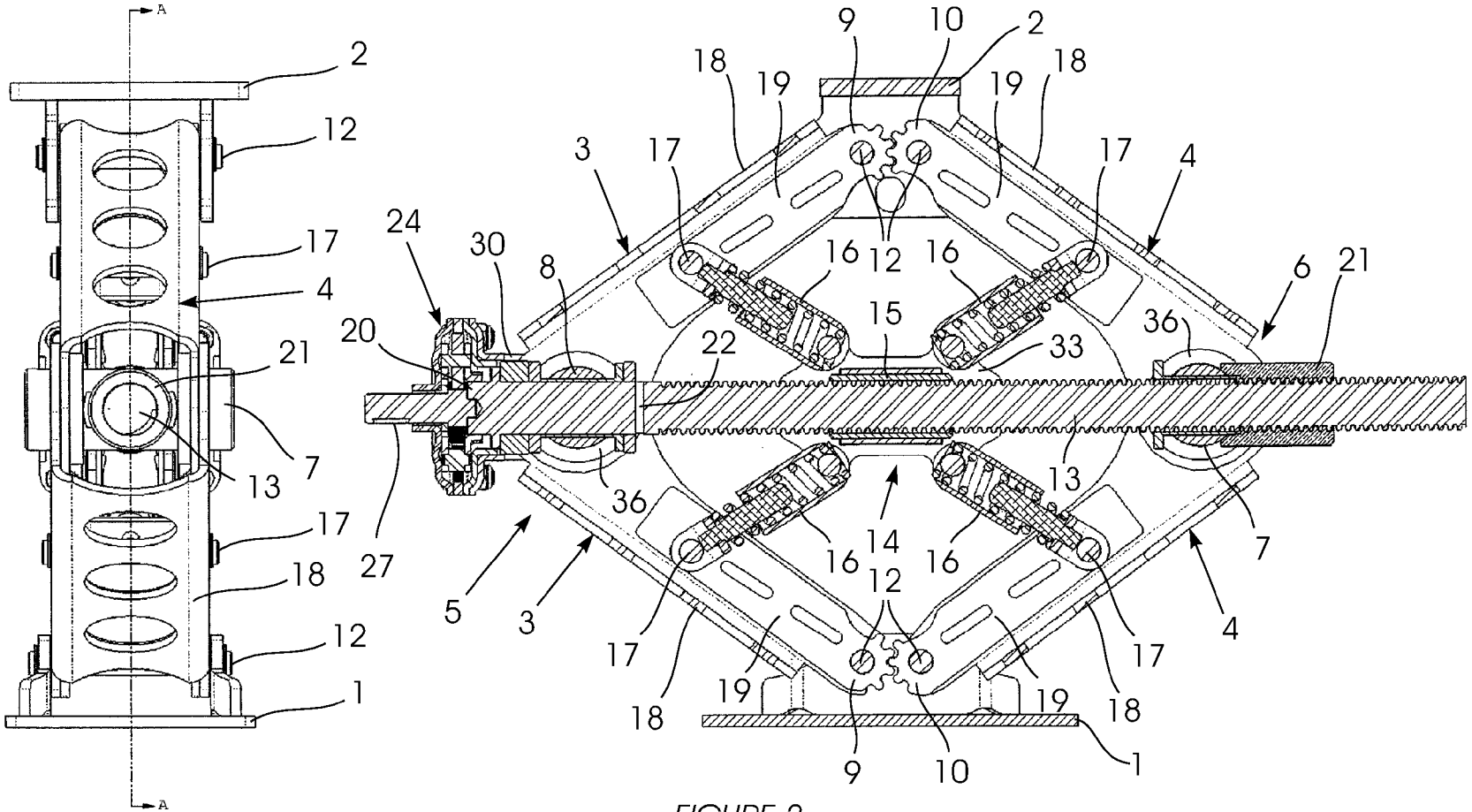
FIG. 2 shows an end view and a cross section through the jack.
Figure 3:
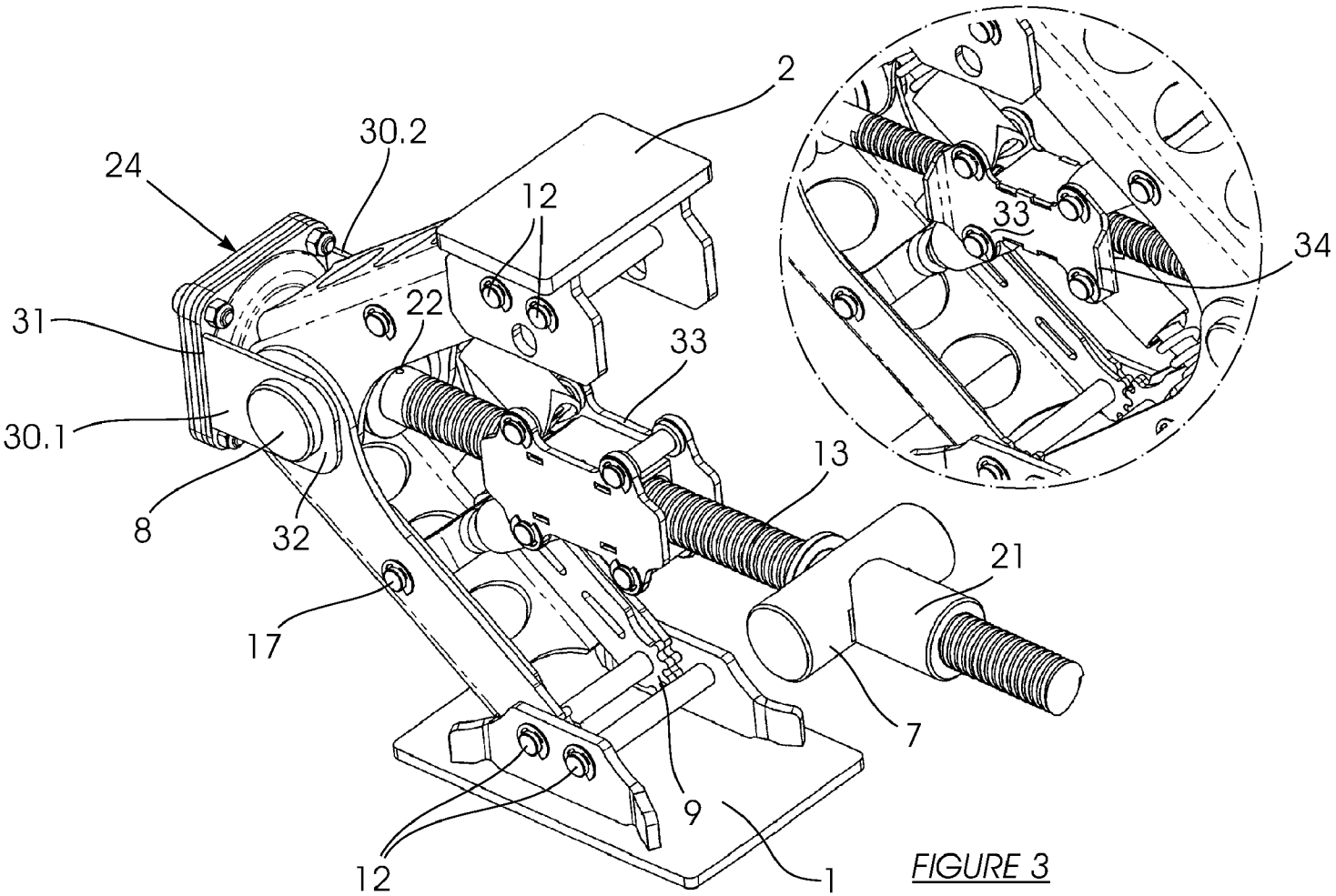
FIG. 3 shows a part cut-away perspective view of the jack.
Figure 4:
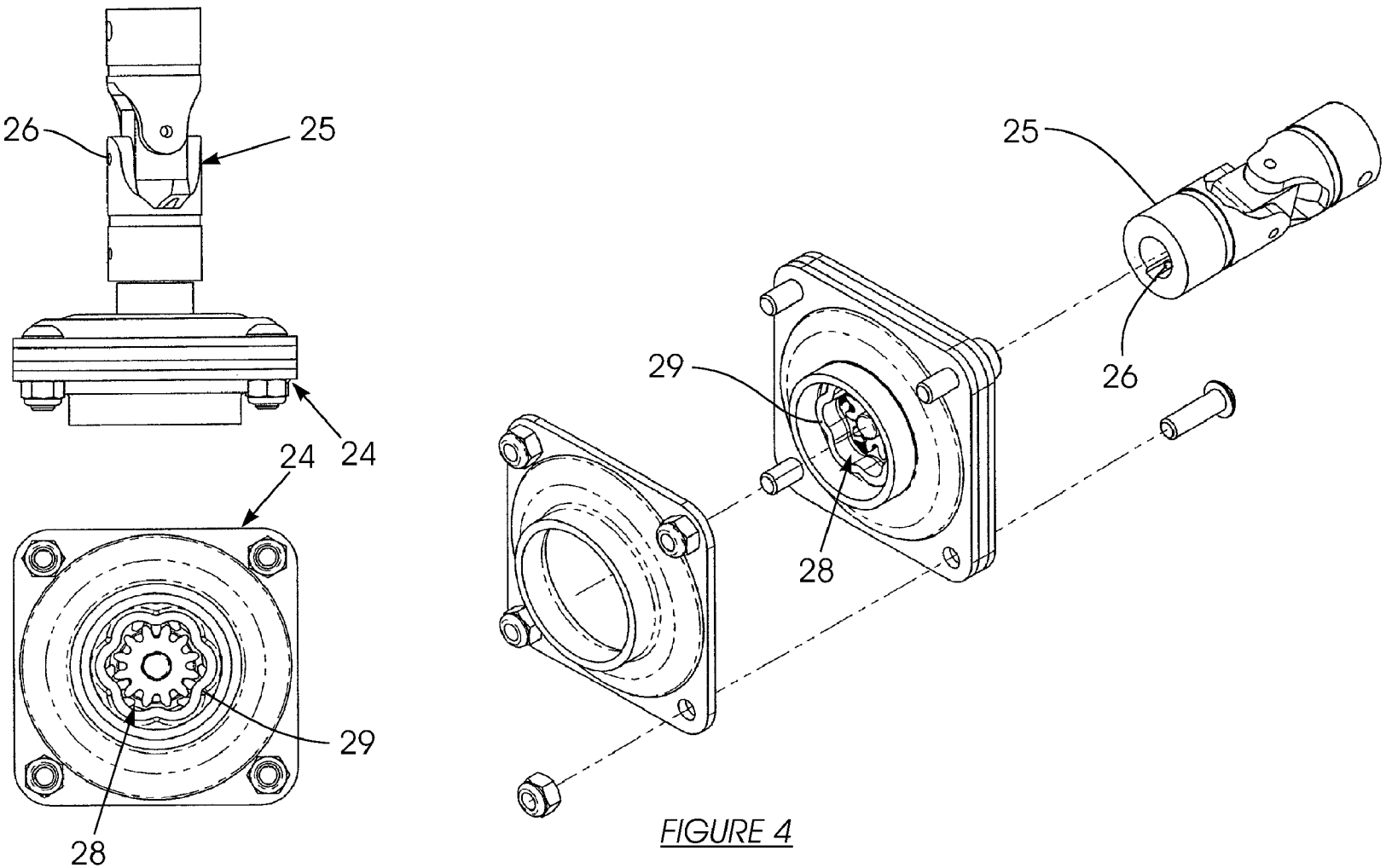
FIG. 4 shows detail of the planetary gearbox.

Referring to FIGS. 1 through 4, a scissor jack has a base (1) separated from a load support (2) by two pairs of arms (3) and (4) as is common with scissor jacks.

The pairs of arms (3) and (4) each has at its connecting elbow (5) and (6) a trunnion (7) and (8). The free ends of arms (3) and (4) are geared to move in unison by gear sections (9) and (10) supported on both the base (1) and load support (2) by pins (12).

A threaded shaft (13) extends through the trunnions (7) and (8) and has slidably mounted thereon a brace (14) consisting of a block (15) with a longitudinal bore receiving the shaft (13). The block (15) or at least the bore therethrough, will preferably have self lubricating properties. Compression spring biased extensible connectors (16) connect the block (15) to the arms (3) and (4) through pivot pins (17).

The pivot pins (17) provided on the arms (3) and (4) each project through flanges of the channel sectional lengths (18) of the arm and through an arm support (19) secured to the flanges, which strengthens the arms (3) and (4).

Each arm support (14) provides the gear section (9) or (10) for its respective arm (3) or (4).

The shaft (13) provides a means for rotation at one end (20) and engages a threaded bush (21) at the other. The bush (21) is fixed to the trunnion (7) and projects a substantial distance beyond the elbow (6). This extension is at least about the length of the diameter of the bush (21) to provide the strength and rigidity necessary for smooth movement of the shaft (13) through the bush (21) when the jack is raised or lowered under load. This is the operating end of the shaft (13).

The trunnion (7) and bush (21) will have co-operating abutting formations for overlapping engagement to prevent rotation of the bush (21) against the trunnion (7). In this embodiment, the trunnion (7) will have a flat surface through which the shaft (13) extends and the end of the bush (21) will be curved to locate over the flat and against the trunnion (7). In addition, a harness (not shown) will extend from the bush (21) to engage over the trunnion (7). This will secure the trunnion (7) to the bush (21) for lowering operations—preventing the bush (21) from moving away from the trunnion (7).

The opposite end of the shaft (13) is freely rotatable in the other, slave trunnion (8). The shaft (13) is held in the trunnion (8) between suitable stops (22). These can conveniently be provided by a washer and a pin through the shaft (13).

End (20) of shaft (13) is connected to a planetary gear box (24) supported from the trunnion (8). The input shaft to the gearbox (24) is adapted to have a universal joint (25) secured thereto through which an operating handle (not shown) can be used to manipulate the jack. A grub-screw or locating pin secured though the universal joint at (26) and extending into a recess (27) will fix the universal joint (25) in place.

The end (20) is shaped with a transverse cross-section complementary to an opening (28) with an undulating edge provided in a rear planetary gear carrier (29). Conveniently, the cross-section will be triangular with rounded corners that fit into three of the six curves of the opening (28). The carrier (29) transmits the output rotation of the gearbox (24) to the shaft (13) through this overlapping engagement. These components (20) and (29) are held together by a bracket (30). The bracket (30) is made up of two plates (30.1) and (30.2) which are welded to the gearbox (24) at (31). Adjacent the free ends (32) of the plates are apertures through which the trunnion (8) extends.

It is a feature of the jack according to the example embodiments that the major components of the planetary gearbox (24) are provided by metal pressings. These add to the simplicity and reduce the cost of the overall construction of the jack. The components are the casing and planetary gear carriers (front and rear) and ring gear which are the larger components and support the smaller sun and planetary gears.

Scissor jacks generally do not settle well into their extended position. The construction illustrated and described above requires spacers (36) between the shaft (13) and the ends of the arms on the trunnions (7) and (8). To assist in achieving the desired firm compact form in the extended position this invention provides for plates (33) which attach the ends of connectors (16) to the block (15) through suitably located pins (34). The arrangement of the spacers (36) is not necessarily symmetrical at the two different elbows (5) and (6). Referring to the insert in FIG. 3, the ends (34) of plates (33) are bent outwardly to ensure that as the jack is extended these ends (34) will contact the spacers on the trunnions (7) and (8) in a positive manner thus providing stability to the extended assembly.

A person skilled in the art will appreciate that a number of variations may be made to the features described without departing from the scope of the example embodiments of the present invention.

The invention claimed is:

1. A scissor jack, comprising:

four arms hingedly arranged to provide two opposite elbows between a base and a load support, a pair of trunnions, one at each elbow connected by a threaded shaft with one end of the threaded shaft rotatably engaged in a threaded bush anchored to one elbow on a trunnion to extend beyond the outer corner of the elbow.

2. The jack of claim 1, wherein the trunnion and bush have co-operating abutting formations for overlapping engagement to prevent rotation of the bush against the trunnion.

3. The jack of claim 1, further comprising a harness extending from the bush to engage the trunnion.

4. The jack of claim 1, further comprising:

a movable brace slidably engaging the shaft between the arms, and connectors pivotably supported between the brace and each arm.

5. A scissor jack, comprising:

four arms hingedly arranged to provide two opposite elbows between a base and a load support, a pair of trunnions, one at each elbow connected by a threaded shaft and a movable brace slidably engaging the shaft between the arms, and connectors pivotably supported between the brace and each arm, wherein the ends of each arm remote from the elbow carries a gear section on the end of an arm support secured to the arm at least from the connector pivot support to its free end.

6. The jack of claim 5, wherein each arm is of channel section along at least part of its length and for the arm supports to be secured to flanges of the channel sections.

7. The jack of claim 5, wherein the gear sections remote from the elbows are mounted in meshing engagement to either a stand for a base or a load support.

8. The jack of claim 5, wherein one end of the threaded shaft is rotatably engaged in a threaded bush anchored to the trunnion at one elbow and extending substantially beyond the outer corner of the elbow.

9. The jack of claim 5, wherein the opposite end of the shaft is rotatably supported in the trunnion of the other elbow and for this end to be secured to the output member of a planetary gearbox.

10. The jack of claim 9, wherein a bracket extends from the planetary gearbox over the trunnion to secure an output member of the gearbox in overlapping engagement with the end of the shaft.

11. The jack of claim 5, wherein the movable brace comprises a block slidable on the threaded shaft and carried between a pair of plates which are pivotally secured to the connectors and bent to provide stops for simultaneous location of the arms with spacers on the trunnions to determine the extended position of the jack.

* * * * *